United States Patent [19]

McNamara

[11] Patent Number: 4,989,854

[45] Date of Patent: Feb. 5, 1991

[54] DOCUMENT SET DELIVERY APPARATUS

[75] Inventor: Michael R. McNamara, Hoddesdon, England

[73] Assignee: Xerox Corporation, Stamford, Conn.

[21] Appl. No.: 206,799

[22] Filed: Jun. 15, 1988

[30] Foreign Application Priority Data

Jun. 26, 1987 [GB] United Kingdom ..... 8715018

[51] Int. Cl.[5] ..... B65H 5/22

[52] U.S. Cl. ..... 271/3.1; 271/213; 270/52

[58] Field of Search ..... 210/37, 52, 53, 58; 271/3, 3.1, 198, 213

[56] References Cited

U.S. PATENT DOCUMENTS 2,724,491 11/1955 Orendorff ..... 198/197
3,669,442 6/1972 Thomas ..... 270/58
4,143,759 3/1979 Paradis ..... 198/668
4,281,920 8/1981 Cross ..... 270/53
4,424,963 1/1984 Bartholet ..... 270/53

FOREIGN PATENT DOCUMENTS 1281974 3/1970 United Kingdom .

*Primary Examiner*—Edward K. Look
*Assistant Examiner*—Therese M. Newholm
*Attorney, Agent, or Firm*—William A. Henry, II

[57] ABSTRACT

A set of copy sheets deposited on a surface is delivered positively to an output by engaging the trail edge of the set with at least two hook-ended projections intended to overlie the top sheet. When the projections are driven in unison, as by a common belt, the hooks prevent the beam strength of the set lifting the trail edge of the set out of contact with the projections.

4 Claims, 1 Drawing Sheet

DOCUMENT SET DELIVERY APPARATUS

This invention relates to apparatus for delivering sets of documents to an output tray or like accumulator.

In one known apparatus, the output of a xerographic copier is accumulated as a stack of copy sheets on a belt kept stationary while the stack is being added to. When the stack is complete, as indicated by the output count equalling the number of documents in the set being copied, the stack is stapled to form a set. After this, the belt is driven to deliver the stapled set to an output tray. Slippage between the belt and the set is prevented by providing the belt with two or more pegs projecting from its surface, which pegs come into contact with the rear face of the set in order to push the set on to the output tray.

Generally, as can be seen in U.S. Pat. No. 2,724,491, a conveyor flight bar cushion is shown in which laterally spaced chains of the conveyor are connected by a plurality of flight bars, each with a plurality of fingers or teeth mounted thereon. The fingers are angled relative to the perpendicular axis of the belt surface. In U.S. Pat. No. 4,143,759 a conveyor belt is disclosed with positionable cleats and including a base member, an angular flange to engage items to be conveyed, and supports providing means to secure the cleats to the belt. The angular flange extends from a side of the base member opposite the supports. The spacing of the cleats is adjustable depending upon the objects being conveyed.

When the sets are of stiff paper or card, or are bulky, and the output tray is below the level of the delivery end of the belt, a problem can arise. This is that, when the lead edge of the set drops down on the output tray, the set is not able to assume the curved shape necessary to keep the rear face of the set concurrently in contact the pegs. In other words, the beam stiffness of the set lifts the rear face of the set off the belt by such an amount that the pegs can slip under the bottom face of the set, resulting in non-positive and incomplete delivery of the set. The present invention aims at solving this problem, and accordingly provides a document set delivery apparatus as claimed in the appended claims.

Figure 1:
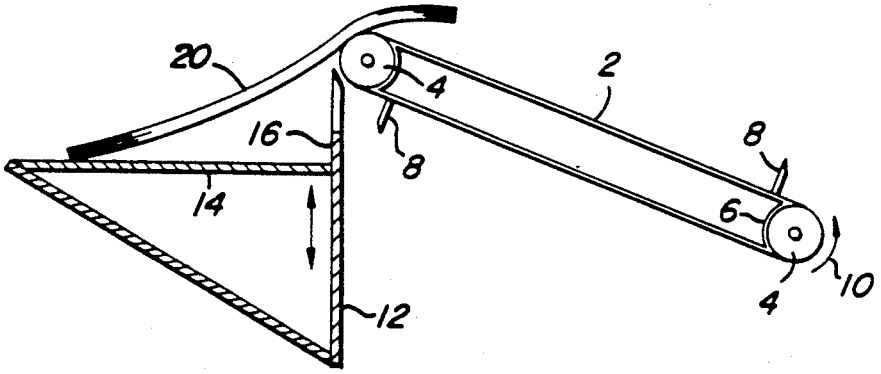
Figure 2:
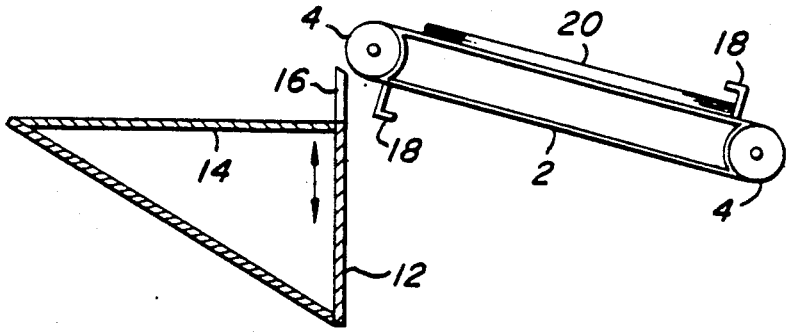
(PRIOR ART) Fig. 2.

The invention will now be described by way of example with reference to the accompanying drawing, in which:

FIG. 1 is a diagrammatic side view of one known form of document set delivery apparatus, and FIG. 2 is a view, similar to FIG. 1, of the apparatus of the present invention.

In that known form of apparatus shown in FIG. 1, the output copy sheets are delivered seriatim on the upper face of a belt 2 extending between a pair of rolls 4, with at least the upper (as viewed) run of the belt resting on a support member 6 positioned between the rolls 4. In this way, the member 6 takes most of the weight of the sheets resting on the belt.

The sheets, in falling under gravity on to the belt surface, may become registered against at least two pegs 8 which are aligned across the width of the belt 2, or alternatively, the sheets may come to be stacked against a registration surface (not shown) having in it slots by means of which the pegs 8 can come into contact with the rear face of the set when the belt is driven.

When the stack of sheets is complete, i.e. when the number of sheets is equal to the number of sides or sheets in the original documents set being copied, then a staple is applied to one corner or the stack, to form them into a set which thereafter can move only en bloc.

After the stack has been stapled, and the set formed, the belt is driven by energisation of a motor (not shown) driving one or other of the rolls 4, in order to drive the belt in an anti-clockwise sense as viewed in the drawing, and as indicated by the arrow 10. As the belt is inclined at an appreciable angle to the horizontal, and is trying to deliver the set uphill, the force of gravity tends to move the set relatively downhill over the belt. This relative movement is stopped by the pegs 8 coming into contact with the rear face of the set, causing the set to move with the belt and pass over the delivery lip provided by the upper of the rolls 4. From there, the set passes over the lip and falls progressively on to an output 12, which may be in the form of a hinged plate biased resiliently into an upper position in which it is spaced by a short distance below the delivery lip. The tray has a support 14, and an upright surface 16 functions to align the stacked sets.

As indicated diagrammatically in FIG. 1, as each set has an increasing proportion of its length fed over the delivery lip, the set tends to flex downwardly until its lead edge comes into contact with the surface of tray 12, after which continued feeding of the set causes the curvature induced in the set to be reversed, leading to the set assuming a sinuous shape, as indicated in FIG. 1. As already discussed, the beam stiffness of the set tends to lift its rear face away from the belt 2 and above the top of the respective pegs 8. Should there be any resistance to further movement of the set, there is a tendency for the pegs then to pass underneath the bottom face of the set so as to lift it and move it further only frictionally, instead of by the positive drive provided by the upright surfaces of the pegs. This can result in the set failing to be delivered properly to the output tray, so that it may foul the later delivery of fresh output sheets which are to form the next set.

In accordance with the present invention, this problem is overcome as shown in FIG. 2, in which parts already shown in FIG. 1 have been given the same references. As indicated in this Figure, the difference is that the pegs 8 of FIG. 1 have been replaced by hook-ended projections 18, with the hooked ends being spaced above the belt 2 by a distance greater than the thickest set which the apparatus is intended to handle. As can be seen from the drawing, the hook also projects forwardly in the direction of movement of the belt, so that the set 20, when assembled immediately prior to, or after, stapling, has its trail end overlain by the two or more aligned hooked ends.

With this arrangement, as the belt is driven so that its upper portion moves uphill, the set 20 flexes as before but, as the lead end of the set bends over the delivery lip, even when the centre of gravity and the beam stiffness would otherwise tend to make the trail end of the set lift up from the belt, it fails to do so by more than a slight amount, i.e. until the top sheets of the set comes into contact with the downwardly-facing surfaces of the hooks. When this happens, the beam strength of the set might well be sufficient to keep the lead end of the set above the output tray 12 in cantilever fashion, at least until the distance between the upper hooks and the delivery lip is so small that the set is able to bend until it contacts the output tray 12, the delivery lip and the hooks 18 concurrently. Thereafter continued movement of the belt causes the trail end of the set to drop from under the hook, which passes around the upper roll 4 and returns to its rest position below the belt.

It will be obvious that various modifications can be made without affecting the invention. Thus, for instance, the belt itself need not carry the weight of the stack or set of documents, in that they could come to lie on a slotted support surface (not shown) overlying the belt, with the hooks 18 extending through the slots. Similarly, the hooks 18 need not function as the registration surface for the sheets as they are accumulated in a stack, but they could come to lie against a slotted surface which is perpendicular to the upper run of the belt. In this latter arrangement, the registration surface would lie in front of the rest position of the hooks. Only after the set has been formed would the belt be driven, to cause the hooks to pass through the slots in the registration surface and come into contact with the rear face of the set.

As will be readily appreciated, the form of the output tray is immaterial. It could be a simple horizontal surface, but preferably it is a movable surface which is designed to give under the weight of the stacked sets so that the former rear ends of the set successively drop away from the deliver lip of the belt, to ensure that the hooks 18 do not foul the previously-accumulated sets at the close of each delivery stroke.

What is claimed is:

1. A document set delivery apparatus, comprising a belt adapted to extend below a supply of sheets delivered seriatim so that they form a stack above an upper run of the belt, which is intended to remain stationary until after the last sheet has been delivered, and at least two projections from the belt surface which are aligned across the width of the belt, each projection having an integral, non-movable portion thereof substantially orthogonal with respect to the upper run of the belt and ending in a forward hook that is parallel to the upper run of the belt and adapted to overlie the rear edge of the set when it is contacted by the orthogonal projections after a major portion of the set has been driven beyond the surface of said belt, and wherein said forward hook of said at least two projections is initially contacted by the set only after the major portion of the set has left the surface of said belt, whereby when the belt is driven in a forward direction to deliver the set to an output tray, the hooked ends of the projections are effective to keep the rear edge of the set in contact with the projections until the set has dropped out of the path of the projections.

2. Apparatus as claimed in claim 1, in which the belt is adapted to support the weight of the stacked sheets directly, with at least the upper run of the belt running over a support surface to which the weight of the stack is able to be transferred through the belt.

3. Apparatus as claimed in claim 2, in which the belt extends at an angle to the horizontal, with a stack being intended to be driven uphill in order to pass from the belt to the output tray.

4. An apparatus for delivering individual sets of documents to an ouput tray in positive registration within the ouput tray, comprising belt means positioned at an acute angle with respect to a document set support surface of said output tray, said belt means being adapted to transport the individual sets of documents from a position upstream of said output tray to a position where the individual document sets fall into said output tray due to gravity, and the projection means extending above the surface of said belt means so as to contact the rear surface of a document set and move it in an uphill direction, said projection means including integral, non-movable hook-ended portions that are substantially parallel to the surface of said belt means in order to keep the rear edge of the document set in contact with the projection means after a major portion of the set has left the surface of said belt until the set has dropped out of the path of the projection means, and wherein said hook-ended portions of said projections means are initially contacted by the set only after the major portion of the set has left the surface of said belt surface of said belt.

* * * * *